United States Patent [19]

Cogliano et al.

[11] 4,129,694

[45] Dec. 12, 1978

[54] FABRIC SOFTENER URETHANE FOAM AND METHOD

[75] Inventors: Joseph A. Cogliano, Baltimore; Clifton L. Kehr, Silver Spring, both of Md.

[73] Assignee: W. R. Grace & Co., New York, N.Y.

[21] Appl. No.: 674,695

[22] Filed: Apr. 7, 1976

[51] Int. Cl.[2] ..... C08G 18/14; C08G 18/10; C08G 18/32; C08G 18/38

[52] U.S. Cl. ..... 521/107; 521/108; 521/116; 521/118; 521/121; 521/125; 521/128; 521/159; 521/905

[58] Field of Search ..... 260/2.5 AD, 2.5 AG, 260/2.5 AM

[56] References Cited

U.S. PATENT DOCUMENTS

| | | | |
|---|---|---|---|
| 2,608,536 | 8/1952 | Sterling | 260/2.5 AG |
| 2,981,700 | 4/1961 | Parker | 260/2.5 AG |
| 3,002,937 | 10/1961 | Parker | 260/2.5 AG |
| 3,098,048 | 7/1963 | Shelanski | 260/2.5 AG |
| 3,433,752 | 3/1969 | Zalgoren | 260/2.5 AG |
| 3,806,474 | 4/1974 | Blair | 260/2.5 AG |
| 3,810,841 | 5/1974 | Richter | 260/2.5 AG |
| 3,890,254 | 6/1975 | Guthrie | 260/2.5 AD |
| 3,897,372 | 7/1975 | Rehr | 260/2.5 AD |
| 3,903,232 | 9/1975 | Wood | 260/2.5 AD |
| 3,904,557 | 9/1975 | Guthrie | 260/2.5 AK |

FOREIGN PATENT DOCUMENTS

| | | | |
|---|---|---|---|
| 1166289 | 10/1969 | United Kingdom | 260/2.5 AD |

*Primary Examiner*—C. Warren Ivy
*Attorney, Agent, or Firm*—Richard P. Plunkett; McDowell, Jr., William W.

[57] ABSTRACT

The invention disclosed relates to a new fabric softener foam having improved utility for softening textile fabrics in either a standard or automatic clothes dryer as well as in an automatic washer.

9 Claims, No Drawings

FABRIC SOFTENER URETHANE FOAM AND METHOD

This invention relates to a new fabric softener polyurethane foam and method for softening textile fabrics in either clothes drying or automatic clothes washing operations.

Numerous attempts have been made in the prior art seeking solutions to improving fabric softening.

Certain chemical compounds have been known in the art to possess the desired quality of imparting softness to textile fabrics. The quality of softness is well defined in the art, and means that a treated fabric is smooth, pliable, and fluffy.

Additionally many of these compounds act to reduce static cling of the treated fabrics. Static cling is, generally, the pheonmenon of fabric adhering as a result of static electrical charges located in the surface of the fabric. By softening and reducing the static cling of a fabric, it is more comfortable when worn. Such treated fabrics additionally are easier to iron, and have fewer hard-to-iron wrinkles.

Softening agents are usually employed in liquid formulations, and powder, tablet and granular formulations. However, such softening compositions have in common their limitation to use in the laundry or fabric washing or rinsing process. Use of these compositions results in many inconveniences.

The prior art suggests coating or impregnation of cellulosic materials with a softening agent with the objective of softening or otherwise treating the cellulosic material itself. Recently suggested is the use of substantially larger amounts of a softening agent coated onto paper for use as a dryer-added softening composition. However, this composition has the serious disadvantage of causing marked staining of the treated fabrics due to its too rapid release of the softener from the paper substrate. The prior art has failed to recognize the importance of controlling release of softener from the substrate by controlling the absorbency of the material used as a substrate.

It has now been found by practice of this invention that a new and useful urethane foam is provided which contains a novel softening composition which can be used in a standard automatic clothes dryer and which need not be limited to use in the rinse cycle of an automatic washer.

The present composition also can be used to impart anti-static qualities to a variety of fabric materials.

By the present invention, fabric softening polyurethane foam is prepared by reacting a particular isocyanate capped polyoxyethylene polyol with large amounts of an aqueous reactant in the presence of a fabric softener. The thus generated polyurethane having fabric softener uniformly disposed throughout is found to have improved fabric softening and static electricity eliminating features.

Generally, the present polyurethane composition includes a hydrophilic polyurethane structure having uniformly dispersed therein a fabric softener.

Practice of the present invention is achieved by means of a softening composition consisting essentially of a fabric softener impregnated into polyurethane foam. Large amounts, generally in excess of 200% by weight of the dry foam of the softening agent are required.

The softening compositions while effective when used to soften fabrics in rinse water, particularly in the rinse cycle of a standard automatic clothes washer, find particular application in effectively softening fabrics in a standard, automatic clothes dryer.

Preferably, the softening composition comprises a softening agent disposed in polyurethane foam and configurated into a tubular roll or individual sheets. A desired length of the treated foam is removed from its package and placed into the clothes dryer wherein the fabrics to be treated have been loaded. The dryer is then operated in customary fashion, and softening occurs as the fabrics directly contact the treated foam, whereby the softening agent is transferred from the foam substrate to the fabric.

If the softening composition is used in a washer, a sheet is placed into the rinse water, e.g., of the final rinse cycle. The softening agent disperses into the rinse water and is then absorbed by the fabrics.

Because the fabric softeners employed herein must be uniformly dispersed in the polyurethane structure, it is advantageous to use a hydrophilic polyurethane prepared by using relatively large amounts of water or aqueous reactant. In this manner, the present additives can be introduced during the reaction step and therby insure uniform distribution. One group of polyurethanes useful herein is disclosed in co-pending, commonly assigned U.S. patent application Ser. No. 404,823 filed Oct. 9, 1973 (now abandoned), effective portions of which are incorporated herein by reference. Generally, these foams are crosslinked polyurethane foams prepared by using a capped polyoxyethylene glycol reactant and massive amounts of water.

The polyoxyethylene polyols used are water soluble reaction products derived from the polymerization of ethylene oxide in the presence of a polyfunctional starter compound such as water, ethylene glycol, glycerol, pentaerythritol, sucrose and the like. The molecular weights may be varied over a wide range by adjusting the relative ratios of ethylene oxide monomer to starter compound. The preferred molecular weight ranges are described subsequently.

It is possible and sometimes desirable to incorporate various amounts of a relatively hydrophobic comonomer into the ethylene oxide based polymerization products. Thus, comonomers such as propylene oxide or butylene oxide may be copolymerized as a random copolymer, block copolymer, or both, such that the copolymers remain hydrophilic while having other desirable features for certain applications, namely improved low temperature flexibility, resistance to compression set, resiliency and the like. Up to about 40–60 mole percent but desirably about 25–45 mole percent of the relatively hydrophobic comonomer may be copolymerized with the ethylene oxide monomer and still yield hydrophilic crosslinked network foams when those products are used as polyol intermediates in practicing the present invention. Thus, polyoxyethylene polyol is intended to include not only homopolymers of ethylene oxide, but also hydrophilic copolymers of ethylene oxide such as those described above, wherein all of these polyol derivatives have a hydroxyl functionality of about two or greater and an ethylene oxide content ranging from about 40 mole percent to about 100 mole percent, and preferably greater than about 55 mole percent.

Particularly useful foams may be prepared by first capping a polyoxyethylene polyol with a polyisocyanate such that the capped product has a reaction functionality greater than two. Thereafter, the resin is reacted by combining with water such that a crosslinked foam result. It is also possible to use a capped polyoxyethylene polyol having a functionality approximating 2 in which case a polyfunctional reactive member such as one having three, or up to about 8 reactive amine, hydroxy, thiol, or carboxylate sites per average molecule is included to form a three dimensional crosslinked product. Useful polyfunctional reactive members include materials such as diethylenetriamine, triethylenetetramine, tetraethylene-pentamine, polyethyleneimine, glycerol, trimethylolpropane, pentaerythritol, tolylene-2,4,6-triamine, ethylenediamine, trimethylenediamine, tetramethylenediamine, pentamethylenediamine, hexamethylenediamine, aminoethanol, diethanolamine, hydrazine, triethanolamine, benzene-1,2,4- tricarboxylic acid, nitrilotriacetic acid, citric acid,4,4',-methylenebis (p-chloraniline), and the like.

Polyoxyethylene polyol used as a reactant in preparing the capped product to be foamed may have a weight average molecular weight of about 200 to about 20,000, and preferably between about 600 to about 6,000, with a hydroxyl functionality of about 2 or greater, preferably from about 2 to about 8.

Polyoxyethylene polyol is capped by reaction with a polyisocyanate or polyisothiocyanates. The capping materials include PAPI (a polyaryl polyisocyanate as defined in U.S. Pat. No. 2,683,730), tolylene diisocyanate, triphenylmethane-4,4',4'',-triisocyanate, benzene-1,3,5-triisocyanate, toluene-2,4,6-triisocyanate,diphenyl-2,3,3'-triisocyanate, hexamethylene diisocyanate, xylene diisocyanate, naphthalene-1, 5-diisocyanate, xylene-alpha, alpha' diisothiocyanate, 3,3'-dimethyl-4,4'-biphenylene diisocyanate, 3,3'-dimethoxy-4,4'-biphenylene diisocyanate, 2,2' 5,5'-tetramethyl-4,4'-biphenylene diisocyanate, 4,4'-methylenebis (phenylisocyanate), 4,4'-sulfonylbis (phenylisocyanate), 4,4'-methylene diortho-tolylisocyanate, ethylene diisocyanate, ethylene diisothiocyanate, trimethylenediisocyanate and the like.

Capping of the polyoxyethylene polyol may be effected using either about stoichometric amounts of reactants or an excess of isocyanate to insure complete capping of the polyol.

To effect foaming and preparation of the crosslinked network polymer, the component including the isocyanate capped polyoxyethylene polyol having a functionality about 2 or greater is simply combined with water by most any suitable means such that a crosslinked hydrophilic foam results.

Although foaming of the present resin reaction is effected simply, it is also possible to add, although not necessary, supplemental foaming materials such as those well known to the artificial sponge foaming art.

To effect foaming and preparation of the crosslinked network polymer, the component including the isocyanate capped polyoxyethylene polyol having a functionality about 2 or greater is simply combined with a particular aqueous component. For simplicity, this isocyanate capped reaction component will herein be referred to as resin reactant.

The aqueous component may appear as water, a water slurry or suspension, a water emulsion, or a water solution having water soluble materials disposed therein. For convenience, the aqueous component is referred to herein as an aqueous reactant.

In contrast to typical polyurethane reactions such as those using catalyst or like promoters where one mole of —NCO is reacted with one-half mole water, the present reaction proceeds simply with a large but controlled excess of water.

In typical polyurethane reactions known to the art, it is known to employ an excess of water in prepolymer foaming formulations to obtain improved properties. It is further known that if less than stoichiometric amounts of water are used, the foam is more crosslinked, firmer, has lower elongation and higher density. A large excess of water will use up the free isocyanate groups, leaving insufficient isocyanate available for effective crosslinking and resulting in the formation of many free amino end groups. As water content increases, the foam density decreases and above 30–50% excess water over stoichiometry results in a marked decrease in physical properties.

The dramatic way in which the addition of water influences practice of the present invention is seen by consideration of the Water Index Value defined as equivalents of $H_2O \times 100$ divided by equivalents of NCO. In polyurethane foaming reactions one mole of water ultimately consumes two NCO groups, i.e. 1.0 mole $H_2O$ = 2 equivalents —OH which react with 2 equivalents of NCO. A Water Index Value of 100 indicates the equivalents of water and equivalents of isocyanate are balanced. An Index of 95 indicates that there is a 5% shortage of water equivalents while an Index of 105 indicates a 5% surplus of water equivalents. A slight shortage of water equivalents (i.e. a slight excess of isocyanate), usually 3–5%, is common practice in the prior art, particularly with flexible foams.

Using the present resin reactant and water in amounts from about 0.5 mole $H_2O$/mole NCO groups ($H_2O$ Index Value of 100) up to about 2 moles $H_2O$/mole NCO groups ($H_2O$ Index Value of 400) results in poor foaming unless materials such as surfactants and catalysts or the like are included. Amounts up to about 2 moles $H_2O$/mole NCO ($H_2O$ Index Value of 400) require a catalyst. When using about 6.5 moles $H_2O$ mole/NCO groups ($H_2O$ Index Value of 1300) up to about 390 moles $H_2O$/mole NCO groups, ($H_2O$ Index Vlaue 78,000) surprisingly good foams result which improve in characteristics with added amounts of molar water. Thus, the available water content in the aqueous reactant is from about 6.5 to about 390 moles $H_2O$/NCO groups in the resin reactant, i.e. an $H_2O$ Index Value of about 1300 to about 78,000 and desirably from about 4,000 to about 40,000, i.e. about 20 to about 200 moles $H_2O$/NCO groups.

"Available water" in the aqueous reactant is that water accessible for reaction with the resin reactant, and which is exclusive of water which may layer during reaction or supplemental water which may be necessary because of further water-absorbtive or water-binding components or additives present in and forming the aqueous reactant.

The use of large molar excesses of water in the aqueous reactant leads to several important advantages and improvements over the conventional polyurethane foam compositions. For example, in conventional polyurethane foam compositions, the water concentration must be carefully controlled to near the theoretical amount, usually an amount much less than about an $H_2O$ Index Value of 400 (2.0 moles $H_2O$/NCO groups in the polyurethane reaction components) and the fabric softeners must be separately included. This low concentration dictates the use of a catalyst to promote the rate of the polymerization foaming reaction, and requires an intensive mixing step to achieve good mixing of reactants and catalyst so as to insure a controllable and uniform cellular product, other additives are avoided. In contrast, the present polyurethane foam requires very large but controlled excess of water, e.g., typically about an $H_2O$ Index Value of about 1300 to about 78,000. Using this technique, the product quality and uniformity is not highly sensitive to accuracy of metering or mixing of the aqueous reactant and the use of a polymerization catalyst or promoter is optional. Thus, the fabric softeners are included in the polyurethane structure at the time of foaming.

The hydrophilic foams of the present invention may be formulated so as to be flexible, semi-rigid or rigid in nature and to be of primarily open cell or primarily closed cell structure as desired.

Fabric softeners can be used singly or, in admixture with compatible fabric softeners. The fabric softeners which contain at least one long chain group includes cationic quaternary ammonium salts including quaternary imidazolinium salts; nonionic compounds, such as tertiary phosphine oxides, tertiary amine oxides and ethoxylated alcohols and alkylphenols; anionic soaps, sulfates and sulfonates, e.g., fatty acid soaps, ethoxylated alcohol sulfates and sodium alkyl sulfates, alkyl sulfonates, sodium alkylbenzenesulfonates, and sodium or potassium alkylglycerylethersulfonates; Zwitterionic quaternary ammonium compounds; ampholytic tertiary ammonium compounds; and compatible mixtures of one or more compounds of these classes.

Desirably, the fabric softener exhibits a softening point below a temperature of about 170° F., i.e. the temperature at which the fabric softener becomes sufficiently liquefied to adhere to fabrics contacting the softener-impregnated polyurethane foam.

To insure adequate softening of fabrics in a dryer, the fabric softener must have a softening point within the temperature ranges of a standard, automatic clothes dryer. Dryer temperatures start at 75° F. and reach up to about 170° F.

Many fabric softeners have softening points above the previously indicated ranges. These fabric softeners can be lowered to a desired temperature by the addition of ethyl alcohol, isopropyl alcohol, or an isoproply alcohol/water mixture or less volatile compounds.

Because of their known softening efficacy, the most preferred cationic softening agents are dialkyl dimethyl ammonium chloride or alkyl trimethyl ammonium chloride wherein the alkyl contains from 12 to 20 carbon atoms and are derived from long chain fatty acids, especially from hydrogenated tallow. The tallow and tallowalkyl are intended to mean alkyls containing from 16 to 18 carbon atoms. Specific examples of the particularly preferred cationic softening agents include tallowtrimethyl ammonium chloride, tallowdimethyl (3-tallowalkoxypropyl) ammonium chloride, ditallow dimethyl ammonium chloride, ditallow dimethyl ammonium methyl sulfate, eicosyltrimethyl ammonium chloride, and dieicosyldimethyl ammonium chloride.

Examples of other preferred cationic softening agents suitable for use in the invention herein include dodecyltrimethyl ammonium chloride, didodecyldimethyl ammonium chloride, tetradecyltrimethyl ammonium chloride, ditetradecyldimethyl ammonium chloride, pentadecyltrimethyl ammonium chloride, dipentadecyldimethyl ammonium chloride, didodecyldiethyl ammonium chloride, didodecyldipropyl ammonium chloride, ditetradecyldiethyl ammonium chloride ditetradecyldipropyl ammonium chloride, ditallowdiethyl ammonium chloride, ditallowdipropyl ammonium chloride, tallowdimethyl benzyl ammonium chloride, tallowdiethyl benzyl ammonium chloride, dodecyltrimethyl ammonium methyl sulfate, didodecyldiethyl ammonium acetate tallowtrimethyl ammonium acetate, tallowdimethyl benzyl ammonium nitrite, and ditallowdipropyl ammonium phosphate.

Other cationic softening agents are known and include variables wherein R and $R_1$ can also represent a phenyl radical or a hydroxy substituted alkyl of from 1 to 3 carbon atoms.

Cationic quaternary imidazolinium compounds are also preferred as softening agents. These compounds conform to the formula

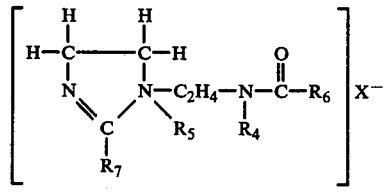

wherein $R_5$ is an alkyl containing from 1 to 4, preferably from 1 to 2, carbon atoms, $R_6$ is an alkyl containing from 1 to 4 carbon atoms or a hydrogen radical, $R_7$ is an alkyl containing from 8 to 25, preferably at least 15 carbon atoms, $R_4$ is hydrogen or an alkyl containing from 8 to 25 preferably at least 15, carbon atoms, and X is an anion, preferably menthyl sulfate or chloride ions. Particularly preferred are those compounds in which both $R_4$ and $R_7$ are alkyls of from 16 to 25, especially 16 to 18 and 20 to 22, carbon atoms.

Many other cationic quaternary ammonium softening agents, which are useful herein, are known; for example, alkyl [$C_{12}$ to $C_{20}$] - pyridinium chlorides, alkyl [$C_{12}$ to $C_{20}$]-alkyl [$C_1$ to $C_3$]-morpholinium chlorides, and quaternary derivatives of amino acids and amino esters.

Other preferred softening agents include Zwitterionic quaternary ammonium compounds which have the formula

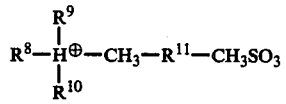

wherein $R_9$ and $R_{10}$ are each methyl, ethyl, n-propyl, isopropyl, 2-hydroxyethyl or 2-hydroxypropyl, $R_8$ is 20 to 30 carbon atom alkyl or alkenyl and wherein said alkyl or alkenyl contains from 0 to 2 hydroxyl substitutnts, from 0 to 5 ether linkages, and from 0 to 1 amide linkage, and $R_{11}$ is an alkylene group containing from 1 to 4 carbon atoms with from 0 to 1 kydroxyl substituents; particularly preferred are compounds wherein $R_8$ is a carbon chain containing from 20 to 26 carbon atoms selected from the group consisting of alkyls and alkenyls and wherein said alkyls and alkenyls contain 0 to 2 hydroxyl substituents. Specific examples of the particularly preferred compounds of this class include 3-N-eicosyl-N,N-dimethylammonio)-2-hydroxypropane-1-sulfonate, 3-(N-eicosyl-N,N-dimethylammonio)-propane-1-sulfonate, 3-[N-eicosyl-N,N-di(2-hydroxyethyl) ammonio]-2-hydroxypropane-1-sulfonate 3-(N-docosyl-N,N-dimethylammonio)-2-hydroxypropane-1-sulfonate, 3-(N-docosyl-N,N-dimethylammonio)-propane-1-sulfonate, 3-[N-docosyl-N,N-bis-(2-hydroxyethyl)ammonio] 2-hydroxypropane-1-1sulfonate, 3-(N-tetracosyl-N,N-dimethylammonio)-2-hydroxypropane-1-sulfonate, 3-(N-tetracosyl-N,N-dimethylammonio)-propane-1-sulfonate, 3-[N-tetracosyl-N,N-bis-(2-hydroxyethyl) ammonio]-2-hydroxypropane-1-sulfonate, 3-[N-tetracosyl-N,N-bis-(2-hydroxyethyl) ammonio]-2-hydroxypropane-1-sulfonate, 3-(N-hexacysyl-N,N-diemthylammonio)-2-hydroxypropane-1-sulfonate, 3-(N-hexacosyl-N,N-dimethy-ammonio)-propane-1-sulfonate.

Examples of other preferred compounds of this case are 3-(N-eicosyl-N-ethyl-Nmethylammonio)-2-hydroxypropane-1-sulfonate, 3-N-dicosyl-N-ethyl-N-methylammonio)-2-hydroxypropane-1-sulfonate, 3-(N-tetracosyl-N-ethyl-N-methylammonio)-2-hydroxypropane-1-sulfonate, 3-(N-heneicosyl-N,N-dimethylammonio)-2-hydroxypropane-1-sulfonate, 3-(N-tricosyl-N,N-dimethylammonio)-2-hydroxypropane-1-sulfonate, 3-(N-tricosyl-N-ethyl-N-methylammonio)-2-hydroxypropane-1-sulfonate, 3-(N-tricosyl-N,N-dimethylammonio)-propane-1-sulfonate, 3-(N-pentacosyl-N,N-dimethyl ammonio)-2-hydroxypropane-1-sulfonate, 3-[N-(2-methoxydoscosyl)-N,N-dimethylammonio]-2-hydroxypropane-1-sulfonate, 3-(N-heptacosyl-N,N-dimethylammonio)propane-1-sulfonate, 3-(N-ocatacosyl-N,N-dimethylammonio)-2-hydroxypropane-1-sulfonate, 3-N-noncosyl-N,N-dimethylammonio)-2-hydroxypropane-1-sulfonate, 3-(N-1-triacontyl-N,N-dimethylammonio) propane-1-sulfonate, 3-[N-(3,5-dioxatetracosyl)-N,N-dimethylammonio]-2-hydroxy propane-1-sulfonate.

Other Zwitterionic known compounds include Zwitterionic synthetic detergents as represented by derivatives of aliphatic quaternary ammonium compounds wherein one of the four aliphatic groups has about 8 to 20 carbon atoms, another contains a water-solubilizing group such as carboxy, sulfato or sulfo groups any of which are straight or branched.

Nonionic tertiary phosphine oxide compounds have the generic formula:

$$R_{12}R_{13}R_{14}P\rightarrow O$$

wherein $R_{12}$ is alkyl, alkenyl, or monohydroxy alkyl having a chain length of from 20 to 30 carbon atoms, and wherein $R_{13}$ and $R_{14}$ are each alkyl or monohydroxyl alkyl containing from 1 to 4 carbon atoms; particularly preferred are tertiary phosphone oxides in which $R_{12}$ is alkyl, alkenyl and monohydroxy alkyl having a chain length of from 20 to 36 carbon atoms and wherein $R_{13}$ and $R_{14}$ are each menthyl, ethyl or ethanol.

Specific examples of particularly softeners of this class include eicosyldimethylphosphine oxide, eicosyldi (2-hydroxyethyl) phosphine oxide, docosyldimethylphosphine oxide, docosyldi(2-hydroxyethyl) phosphine oxide tetracosyldimethylphosphine oxide, hexacosyldimethylphosphine oxide, eicosyldiethylphosphine oxide, docosyldiethylphosphine oxide, and tetracosyldi(2-hydroxyethyl) phosphine oxide.

Examples of other tertiary phosphine oxides of this class include eicosylmethylethylphosphine oxide, heneicosyldimethylphosphine oxide, β-hydroxyeicosyldimethylphosphine oxide, β-hydroxydocosyldimethylphosphine oxide, heneicosylmethylethylphosphine oxide, docosylmethylethylphosphine oxide, tricosyldiethylphosphine oxide, tricosyldimethylphosphine oxide, tetracosyldi (2-hydroxyethyl) phosphine oxide, pentacosyldimethylphosphine oxide, eicosylmethyl-2-hydroxybutylphosphine oxide, eicosyldibutylphosphine oxide- docosylmethyl-3-hydroxybutylphosphine oxide, hexacosyldiethylphosphine oxide, heptacosyldimethylphosphine oxide, octacosyldiethylphosphine oxide, and triacontyldimethylphosphine oxide.

Other nonionic tertiary phosphine oxides useful herein include nonionic synthetic detergents having the same formula immediately above wherein $R_{12}$ is an alkyl, alkenyl, or monohydroxylakyl of from 10 to 20 carbon atoms and wherein $R_{13}$ and $R_{14}$ are each alkyl or monohydroxyalkyl of from 1 to 3 carbon atoms.

Nonionic tertiary amine oxides can be utilized in the compositions of the present invention. These nonionic compounds have the formula $$R_{15}R_{16}R_{17}N\rightarrow O$$

wherein $R_{15}$ represents a straight or branched chain alkyl or alkenyl containing from 20 to 30 carbon atoms and from 0 to 2 hydroxyl substituents, from 0 to 5 ether linkages, there being at least one moiety of at least 20 carbon atoms containing no ether linkages, and 0 to 1 amide linkage, and wherein $R_{16}$ and $R_{17}$ are each alkyl or monohydroxy alkyl groups containing from 1 to 4 carbon atoms and wherein $R_{16}$ and $R_{17}$ can be joined to form a heterocyclic group containing from 4 to 6 carbon atoms; particularly preferred are those wherein $R_{15}$ is a straight or branched alkyl, alkenyl, or monohydroxy alkyl containing 20 to 26 carbon atoms and wherein $R_{16}$ and $R_{17}$ are each methyl, ethyl or ethanol.

Specific examples of compounds of this class include eicocyl-bis-(β-hydroxyethyl) amine oxide, eicosyldimethylamine oxide, docosyldimethylamine oxide, docosyl-bis-(β-hydroxyethyl) amino oxide, tetracosyldimethylamine oxide, tetracosyl-bis-(β-hydroxyethyl) amine oxide, hexacosyldimethylamine oxide, and hexacosyl-bis-(β-hydroxytheyl) amine oxide.

Examples of other tertiary amine oxides of this class include 2-hydroxyeicosyldimethylamine oxide, eicosylmethylethylamine oxide, eicosyldiethylamine oxide, 2-hydroxyeicosyldiethylamine oxide, heneicosyldimethylamine oxide, heneicosyldiethylamine oxide, docosyldiethylamine oxide, tricosyldimethylamine oxide, tricosylidiethylamine oxide, tetracosyldiethylamine oxide, β-hydroxytetracosyldimethylamine oxide, pentacosyldimethylamine oxide, hexacosyldiethylamine oxide, eicosylmethyl(2-hydroxypropyl) amine oxide, docosylbutylmethylamine oxide, 2-docosenyldimethylamine oxide, 2-methoxydocosyldimethylamine oxide, heptacosyldimethylamine oxide, octacosylmethylethylamine oxide, octacosyldiethylamine oxide, nonacosyldimethylamine oxide, triacontyldiethylamine oxide, 3,6-dioxaoctacosyldimethylamine oxide, 2-hydroxy-4-oxatetracosyldimethylamine oxide, 6-stearamidohexyldimethylamine oxide.

Other tertiary amine oxides useful herein are known and include compounds corresponding to the formula immediately above wherein $R_{15}$ is an alkyl of 8 to 20, particularly 16 to 18, carbon atoms, and $R_{16}$ and $R_{17}$ are methyl or ethyl radicals.

Nonionic ethoxylated alcohol compounds are also known softening agents and have the generic formula $$R_{18}—O(C_2H_4O)_xH$$

wherein $R_{18}$ represents an alkyl of from 20 to 30 carbon atoms, and X is an integer of from 3 to 45.

The preferred ethoxylated alcohol compounds of this class are condensation products of reacting from 3 moles to 45 moles of ethylene oxide with one mole of eicosyl alcohol, heneicosyl alcohol, tricosyl alcohol, tetracosyl alcohol, pentacosyl alcohol, or hexacosyl alcohol. Specific examples of the preferred ethoxylated alcohols include products of 3 moles ehtylene oxide and 1 mole of heneicosyl alcohol; 9 moles ethylene oxide and 1 mole eicosyl alcohol; 12 moles ethylene oxide and 1 mole hexacosyl alcohol; 15 moles of ethylene oxide and 1 mole pentacosyl alcohol; and 30 moles of ethylene oxide and 1 mole tricosyl alcohol. Other ethoxylated alcohols are the condenstion products of 3 moles to 45 moles of ethylene oxide with one mole of heptacosyl, octacosyl, nonacosyl, or triacontyl alcohols. Specific examples include 5 moles of ethylene oxide and 1 mole of nonacosyl alcohol; 6 moles of ethylene oxide and 1 mole of heptacosyl alcohol, 9 moles of ethylene oxide and 1 mole of octacosyl alcohol; 20 moles of ethylene oxide and 1 mole of heptacosyl alcohol; 30 moles of ethylene oxide and 1 mole of triacontyl alcohol; and 40 moles of ethylene oxide and 1 mole of nonacosyl alcohol.

Also suitable for use as softening agents are nonionic synthetic detergents as represented by the polyethylene oxide condensates of aliphatic alcohols containing from 8 to 20 carbon atoms and alkylphenols wherein the alkyl contains from 8 to 20 carbon atoms. Particularly preferred are the condensation products of 1 mole of tallow alcohol with 20 moles and with 30 moles of ethylene oxide.

Also preferred as softening agents are anionic ethoxylated alcohol sulfates and anionic sulfonates.

The preferred ethoxylated alcohol sulfates have the generic formula $$R_{19}—O(C_2H_4O)_xSO_3—M+$$

wherein X is an integer of from 1 to 20, M is an alkali metal (e.g., Na, K, Li), ammonium or substituted ammonium cations, and wherein $R_{19}$ is an alkyl containing from 20 to 30 carbon atoms.

The preferred anionic ethoxylated alcohol sulfate softening compounds are the sodium and potassium salts or the monoethanol, diethanol, or triethanol ammonium salts of the sulfated condensation product of from 1 to about 20 moles of ethylene oxide and one mole of eicosyl alcohol, heneicosyl alcohol, tricosyl alcohol, tetracosyl alcohol, pentacosyl alcohol, or hexacosyl alcohol. Specific examples of these particularly preferred anionic softening compounds include the salts of the sulfated condensation products of 1 mole of ethylene oxide and 1 mole of tetracosyl alcohol; 3 moles of ethylene oxide and 1 mole of hexacosyl alcohol; 9 moles of ethylene oxide and 1 mole of tricosyl alcohol; 12 moles of ethylene oxide and 1 mole of eicosyl alcohol; 16 moles of ethylene oxide and 1 mole of pentacosyl alcohol; and 29 moles of ethylene oxide and 1 mole of heneicosyl alcohol.

Other anionic ethoxylated sulfate compounds are sodium or potassium salts or monoethanol, diethanol, or triethanol ammonium cations of the sulfated condensation products of from 1 to 20 moles of ethylene oxide with one mole of heptacosyl alcohol, octacosyl alcohol, nonacosyl alcohol and triacontyl alcohol.

Anionic synthetic detergents are replaced by alkyl sulfates of the formula:

$$R_{20}—OSO_3—M+$$

wherein M is an alkali metal and R is an alkyl of from 8 to 20 carbon atoms are also useful as softening agents herein.

The anionic sulfates have the general formula:

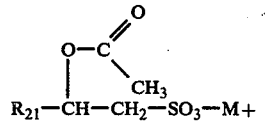

wherein M is an alkali metal or a substituted ammonium cation, and $R_{21}$ is an alkyl containing from 20 to 30 carbon atoms. The particularly preferred anionic sulfonates are those in which $R_{21}$ is an alkyl containing from 20 to 26 carbon atoms. Examples of the particularly preferred compounds include sodium or potassium 2-acetoxydocosylsulfonate, ammonium 2-acetoxydocosylsulfonate, diethanolammonium 2-acetoxydocosylsulfonate sodium or potassium 2-acetoxytricosylsulfonate, sodium or potassium 2-acetoxytertracosylsulfonate, sodium or potassium 2-acetoxypentacosylsulfonate, sodium or porassium 2 acetoxyhexacosylsulfonate, sodium or potassium 2 acetoxyhepatacosylsulfonate, and sodium or potassium 2-acetoxyoctacosylsulfonate.

Other anionic sulfonates include sodium or potassium 2-acetoxynonacosylsulfonate, 2-acetoxytriacontylsulfonate, 2-acetoxyheneitriacontylsulfonate, and 2-acetoxydotriacontysulfonate.

Other anionic sulfonates useful as softening agents are synthetic detergents of sodium or potassium alkylbenzenenesulfonates and sodium alkyl-gylcerylethersulfonates wherein the alkyl containing from 10 to 20 carbon atoms.

Additionally, ampholytic synthetic detergents of the formula:

$$R_{22}—N—(CH_3)_3—CH_3+B—$$

wherein $R_{22}$ is an alkyl of from 8 to 18 carbon atoms, A is $R_{22}$ or hydrogen and B is a water-solubilizing group (particularly $SO_3$—), can be used as softening agents.

Admixture of one or more softening agents can be used. Examples of Admixtures suitable for use herein include the following, wherein all percentages are by weight of the admixture:

| INGREDIENT | PERCENT |
|---|---|
| Ditallowdimethyl ammonium chloride | 65 |
| Tallowdimethylphosphine oxide | 35 |
| Eicosyltrimethyl ammonium chloride | 30 |
| Hexacosyldimethylamine oxide | 70 |
| Eicosyltrimethyl ammonium chloride | 60 |
| $TAE_{30}$ | 40 |
| Ditallowdimethyl ammonium chloride | 45 |
| 3-(N-eicosyl-N,N dimethylammonio)-2-hydroxy-propane-1-sulfonate | 55 |
| Ditallowdimethyl ammonium chloride | 60 |
| Eicosyldimethylamine oxide | 40 |
| Ditallowdimethyl ammonium chloride | 50 |
| 3 - (N-eicosyl-N,N-dimethylammonio)-propane-1-sulfonate | 50 |
| Eicosyltrimethyl ammonium chloride | 50 |
| 3 - (N-docosyl-N-ethyl-N-methylammonio)-2-hydroxy propane-sulfonate | 50 |
| Sulfated condensation product of 9 moles of ethylene oxide + mole of eicosyl alcohol | 50 |
| Condensation product of 9 moles of ethylene oxide 1 mole eicosyl alcohol | 50 |
| Sodium 2-acetoxydocosylsulfonate | 40 |
| $TAE_{20}$ | 60 |
| sodium 2-acetoxydocosylsulfonate | 60 |
| Tetracosyldimethylphosphine oxide | 40 |

-continued

| INGREDIENT | PERCENT |
|---|---|
| Diethanolammonium 2-acetoxydocosylsulfonate | 75 |
| Dodecyldimethylamine oxide | 25 |
| Dodecylbenzenesulfonate | 45 |
| $TAE_{20}$ | 55 |
| 3 - (N-eicosyl-N,N-dimethylammonio)-2-hydroxypropropane-1-sulfonate | 70 |
| Condensation product of 30 moles of ethylene oxide+1 mole tricosylalcohol | 30 |
| 3 - (N-docosyl-N,N-dimethylammonio)-2-hydroxypropane-1-sulfonate | 65 |
| $TAE_{30}$ | 35 |
| 3 - (N-tetracosyl-N,N-dimethylammonio)-2-hydroxy propane-1-sulfonate | 45 |
| Tetracosyldimethyl phosphine oxide | 55 |
| 3 - (N-tetracosyl)-N,N-dimethylammonio)-2-hydroxypropane-1-sulfonate | 75 |
| Tallowdimethylamine oxide | 25 |

Anionic soaps, i.e., the sodium salts of long-chain fatty acids, such as lauric, myristic, palmitic, stearic, and arachiodonic acids, can also be used as a softening agent herein and many such compounds are known in the art.

Other additives can also be used in combination with the softening agent. Although not essential, certain of these additives are particularly desirable and useful, such as perfumes and brightening agents; shrinkage controllers, anti-static agents, and spotting agents are also useful.

While not essential, liquids which serve as a carrier for the softening agent can be employed. Such liquids aid is releasing the softening agent from the absorbent substrate and in promoting adherence of the softener to the fabric contacting the softener-impregnated substrate. Isopropyl alcohol or isopropyl alcohol-water mixtures are the preferred liquid carriers of these purposes; methanol, ethanol, or acetone can also be used.

Other additives can include anti-creasing agents, finishing agents, fumigants, lubricants, fugicides, and sizing agents.

The amounts of additives that can be used in combination with a softening agent are generally small, being in the range of from 0.01% to 3% by weight of the softening agent.

As previously related, it is immaterial what the conditioning agent is, as long as it is substantive to the fabric upon which it is deposited, and will transfer under the flow of drying air and steam generated from the washed fabric as it is being dried.

In all examples, the compositions and softening formulations are expressed as parts or percentages by weight, unless otherwise noted.

EXAMPLE 1

A prepolymer is prepared from 2 moles of polyethylene glycol 1000, one mole of trimethylolpropane and 7.7 moles of the commercial 80/20 mixture of 2,4 and 2,6-tolyldiisocyanate. 200 Grams of the prepolymer, 2 grams of silicone surfactant L-520 by Union Carbide were mixed. To this was next added 200 grams of water in a dispersion of 60 grams of dimethyl, di(hydrogenated tallow), ammonium chloride (a quaternary ammonium compound known as "Arquad 2HD-75" by Armour Chemical Company) and 1.5 gm. of isopropanol, prepared at 18° C. After all the liquid had been absorbed, and the foam which generated was drid at ambient temperature. The dry substrate carrying the agent was then introduced into a conventional household clothes dryer with an approximate 8 lb. load of damp fabrics which has been spin-dried by centrifugation in the washer. During a conventional drying cycle of about 50 minutes under conventional drying temperature of about 150° f., the substrate was thoroughly tumbled around with the fabric by the drying agitator.

During such treatment, sufficient of the agent transferred from the substrate into the heated air and steam generated from the fabric, and deposited on the fabric pieces rendering them noticeably softer, antistatic and fluffier. In the dryer, the imparted lubricating effect and the freedom from static reduced knotting and binding, thereby substantially reducing wrinkling. The antistatic qualities remained with the fabric pieces until they were rewashed, thus rendering them more comfortable to wear; and because of the softening the need for ironing was minimized and ironing was made easier.

An equivalent composition was achieved when "Arquad 2HT-75" was substituted by "Adogen 448", a substantially solid formulation of 75 parts cationic fabric softener, ditallodimethyl ammonium chloride, 18 parts isopropyl alcohol and 7 parts water.

EXAMPLE 2

The following softening compositions were made by substituting the fabric softeners described below, using the procedure and substrate of Example 1. A softening formulation consisting of 98% "Aliquat- 264" and 2% perfume was used. Aliquat-264 is a liquid formulation of 18 parts isopropyl alcohol, 6 parts water and 76 parts cationic fabric softener, di-tall oil dimethyl ammonium chloride wherein the tall oil is unsaturated and has mostly $C_{18}$, some $C_{16}$ and $C_{14}$ carbon chain lengths.

EXAMPLE 3

150 Grams of tallowdimethyl (3-tallowalkoxypropyl) ammonium chloride was solvent-treated with about 50 grams of 2-propanol. 2 grams of perfume was added to the softener/alcohol formulation. The composition combined with the substrate of Example 1 and after foaming was dried for 24 hours, during which time nearly all of the alcohol evaporated, leaving a substantially solid softening composition; disposed in a foam substrate.

EXAMPLE 4

A softening formulation comprising 58% $C_{20}$–$C_{22}$ alkyl-dimethyl amine oxide, about 21% isopropanol, and about 20% water, was heated to about 150° F. on a steam bath. 100 grams of the formulation was solvent-treated with 100 grams of isopropanol. 2 Grams of perfume was added to the softener/alcohol and water formulation and the formulation was then reacted with the prepolymer. The generated foam was dried and was found to have fabric softening characteristics.

EXAMPLE 5

60 Grams of the fabric softener, 2-heptadecyl-1-methyl-1-[(2-stearoylamido)ethyl]-imidazolinium methyl sulfate was added to the water reactant and reacted with the prepolymer. After the generated foam was dried, it was found to have fabric softening characteristics.

It is understood that the foregoing detailed description is given merely by way of illustration and that many variations may be made therein without departing from the spirit of this invention.

What is claimed is:

1. In a cross-linked hydrophilic polyurethane foam system having three-dimensional network which consists essentially of the reaction product of a first component comprising isocyanate capped hydrophilic polyoxyethylene polyol resin prepolymer with an isocyanate functionality equal to 2 and crosslinking agent having a reaction functionality greater than two, said crosslinking agent selected from the group consisting of polyol, polyamine, polythiol or polyisocyanate; or said isocyanate capped polyol with an isocyanate functionality greater than 2; and a second component comprising water, wherein the $H_2O$ Index Value of said isocyanate capped polyol and water is about 1,300 to about 78,000, wherein the polyoxyethylene polyol moiety has a weight average molecular weight of about 200 to about 20,000, and a hydroxyl functionality of about 2 to about 8, the improvement which consists essentially of inclusion of a fabric softener during foaming reaction, at least 200% of said fabric softener being present in the foam,

2. In the method for preparing cross-linked hydrophilic polyurethane foam system having three-dimensional network which consists essentially of reacting a first component comprising isocyanate capped hydrophilic polyoxyethylene polyol resin prepolymer with an isocyanate functionality equal to 2 and a crosslinking agent having a reaction functionality greater than two, said crosslinking agent selected from the group consisting of polyol, polyamine, polythiol or polyisocyanate; or said isocyanate capped polyol with an isocyanate functionality greater than 2; and a second component comprising water, wherein the $H_2O$ Index Value of said capped polyol and water is about 1,300 to about 78,000 wherein the polyoxyethylene polyol moiety has a weight average molecular weight of about 200 to about 20,000, and a hydroxyl functionality of about 2 to about 8, the improvement which consists essentially of inclusion in said reaction of a fabric softener, a sufficient amount of said fabric softener being employed to provide at least 200% of softener in the finished foam, based on the dry foam weight.

3. A foam as in claim 1 wherein the fabric softener is a quaternary ammonium salt.

4. A foam as in claim 1 wherein the fabric softener is an amine oxide.

5. A foam as in claim 1 wherein the fabric softener is a quaternary imidazolinium salt.

6. A method as in claim 2 wherein the fabric softener is a quaternary ammonium salt.

7. A method as in claim 2 wherein the fabric softener is an amine oxide.

8. A method as in claim 2 wherein the fabric softener is a quaternary imidazolinium salt.

9. In the method for preparing cross-linked hydrophilic polyurethane foam system having three-dimensional network which consists essentially of reacting a first component comprising isocyanate capped hydrophilic polyoxyethylene polyol resin prepolymer with an isocyanate functionality equal to 2 and a crosslinking agent having a reaction functionality greater than two, said crosslinking agent selected from the group consisting of polyol, polyamine, polythiol or polyisocyanate; or said isocyanate capped polyol with an isocyanate functionality greater than 2; and a second component comprising water, wherein the $H_2O$ Index Value of said capped polyol and water is about 1,300 to about 78,000 wherein the polyoxyethylene polyol moiety has a weight average molecular weight of about 200 to about 20,000, and a hydroxyl functionality of about 2 to about 8, the improvement which consists essentially of inclusion in said reaction of a fabric softener selected from the group consisting of a quaternary ammonium salt, an amine oxide and a quaternary imidazolinium salt, a sufficient amount of said fabric softener being employed to provide at least 200% of softener in the finished foam, based on the dry foam weight.

* * * * *

UNITED STATES PATENT AND TRADEMARK OFFICE

CERTIFICATE OF CORRECTION

PATENT NO. : 4,129,694

DATED : December 12, 1978

INVENTOR(S) : Joseph A. Cogliano and Clifton L. Kehr

It is certified that error appears in the above-identified patent and that said Letters Patent are hereby corrected as shown below:

In the Claims:

In column 13, line 18, add --based on the dry foam weight.--

Signed and Sealed this

*Tenth* Day of *April 1979*

[SEAL]

*Attest:*

RUTH C. MASON
*Attesting Officer*

DONALD W. BANNER
*Commissioner of Patents and Trademarks*